US011809139B2

(12) United States Patent
Kanmaz

(10) Patent No.: US 11,809,139 B2
(45) Date of Patent: Nov. 7, 2023

(54) LOCKING SYSTEM FOR A CONTROL ELEMENT OF A TIMEPIECE

(71) Applicant: ROLEX SA, Geneva (CH)

(72) Inventor: Mesut Kanmaz, Cranves-Sales (FR)

(73) Assignee: ROLEX SA, Geneva (CH)

( * ) Notice: Subject to any disclaimer, the term of this patent is extended or adjusted under 35 U.S.C. 154(b) by 1034 days.

(21) Appl. No.: 16/373,931

(22) Filed: Apr. 3, 2019

(65) Prior Publication Data

US 2019/0324405 A1 Oct. 24, 2019

(30) Foreign Application Priority Data

Apr. 20, 2018 (EP) ..... 18168555

(51) Int. Cl.

| | |
|---|---|
| ***G04B 3/04*** | (2006.01) |
| ***G04B 37/08*** | (2006.01) |
| ***G04B 37/10*** | (2006.01) |
| ***G04C 3/12*** | (2006.01) |

(52) U.S. Cl.
CPC ..... *G04B 3/043* (2013.01); *G04B 37/081* (2013.01); *G04B 37/10* (2013.01); *G04C 3/12* (2013.01)

(58) Field of Classification Search
CPC ..... G04B 3/043; G04B 37/081; G04B 37/10
See application file for complete search history.

(56) References Cited

U.S. PATENT DOCUMENTS 7,293,911 B2 11/2007 Bonvin et al.
8,454,227 B2 6/2013 Romano
2005/0254353 A1* 11/2005 Cogoli ..... G04G 21/00 368/281
2007/0074545 A1 4/2007 Hiranuma et al.
2007/0091727 A1 4/2007 Bonvin et al.
2008/0068934 A1* 3/2008 Hiranuma ..... G04B 3/043 368/288
2010/0128575 A1 5/2010 Okuda
2010/0142333 A1* 6/2010 Hiranuma ..... G04B 19/286 368/319

(Continued)

FOREIGN PATENT DOCUMENTS

CH 423 638 A 7/1966
CH 700 535 A1 9/2010

(Continued)

OTHER PUBLICATIONS

Office Action dated Jul. 28, 2021, issued in counterpart CN Application No. 201910324448.1, with English Translation. (21 pages).

(Continued)

*Primary Examiner* — Edwin A. Leon
*Assistant Examiner* — Jason M Collins
(74) *Attorney, Agent, or Firm* — WHDA, LLP

(57) ABSTRACT

A watch case having a locking system for at least one control element of a timepiece, the locking system including a manipulable element, a locking element for the at least one control element, and a kinematic link linking the manipulable element to the locking element, the locking system being arranged on the outside of a chamber (63), more particularly on the outside of a water-resistant chamber, defined by the case, the locking element being rotatably mounted, more particularly rotatably mounted about a second axis (A1) of the at least one control element.

19 Claims, 10 Drawing Sheets

(56) References Cited

U.S. PATENT DOCUMENTS

| | | | | |
|---|---|---|---|---|
| 2011/0051564 | A1* | 3/2011 | Hiranuma | G04B 3/043 368/147 |
| 2011/0280111 | A1 | 11/2011 | Romano | |
| 2013/0021880 | A1 | 1/2013 | Doi | |
| 2015/0043314 | A1 | 2/2015 | Hiranuma et al. | |
| 2016/0313700 | A1 | 10/2016 | Fraser et al. | |
| 2018/0341228 | A1* | 11/2018 | Loetscher | G04B 37/0008 |

FOREIGN PATENT DOCUMENTS

| | | | |
|---|---|---|---|
| CH | 700 818 | B1 | 10/2010 |
| CH | 704 262 | B1 | 9/2015 |
| CN | 101738922 | A | 6/2010 |
| CN | 102890443 | A | 1/2013 |
| CN | 202677070 | U | 1/2013 |
| CN | 207067683 | U | 3/2018 |
| EP | 1 777 598 | A1 | 4/2007 |
| EP | 2 477 079 | A2 | 7/2012 |
| EP | 2 399 172 | B1 | 4/2013 |
| EP | 3 407 144 | A2 | 11/2018 |
| JP | U5555782 | | 10/1953 |
| JP | 2005-337792 | A | 12/2005 |
| JP | 2010-197195 | A | 9/2010 |
| JP | 2015-36642 | A | 2/2015 |

OTHER PUBLICATIONS

European Search Report and Written Opinion dated Oct. 24, 2018 issued in counterpart application No. EP18168555; w/ English machine translation (11 pages).

Office Action dated Sep. 20, 2022, issued in counterpart JP application No. 2019-071778 with English translation. (15 pages).

* cited by examiner

LOCKING SYSTEM FOR A CONTROL ELEMENT OF A TIMEPIECE

This application claims priority of European patent application No. EP18168555.3 filed Apr. 20, 2018, the content of which is hereby incorporated by reference herein in its entirety.

The invention relates to a locking system for at least one control element of a timepiece. It also relates to a watch case comprising a suchlike system. Finally, it relates to a timepiece, more particularly a wristwatch, comprising a suchlike system or a suchlike case.

Locking devices are known from the prior art.

It is known, for example, to propose a push-button capable of being screwed against a ring so as to secure it in position and, by so doing, to prevent any unintentional activation of a watch function operated by said push-button. There is thus the same number of devices for the activation and deactivation of a push-button as there are push-buttons equipping a timepiece. With the aim of improving the manipulations when being worn, devices permitting the synchronized activation or deactivation of at least two push-buttons, in a single operation, are also proposed. Nevertheless, suchlike devices are not optimal and, more particularly, may prejudice the functional or aesthetic integrity of the timepiece.

Patent CH423638 relates to a specific design of water-resistant and screwed push-button. A ring, threaded and screwed onto the push-button, has the ability to occupy two positions, one, at rest, in which it permits said push-button to be actuated, and the other, in which it is supported on a part of the case of the timepiece in such a way as to exert axial traction on the push-button, which has the effect, on the one hand, of compressing a sealing gasket interposed between said push-button and the element of the case penetrated by the latter, and, on the other hand, of locking the push-button.

Patent application CH704262 discloses a device permitting the synchronized locking of a crown and at least one push-button. A suchlike device is controlled by a ring disposed concentrically on said crown. The manipulations of a suchlike ring may prove to be delicate, more particularly when the latter requires to be actuated under water, for example when taking part in scuba diving.

Patent application EP2399172 relates to an internal locking device for push-buttons of a wristwatch. According to a first embodiment, the push-buttons may be activated or deactivated in a synchronized manner by means of a crown, which is provided for the winding and adjustment of the wristwatch. The screwing-out/screwing-in of said crown brings about the unlocking/locking of the push-buttons by means of an internal mechanism of the case. A suchlike design cannot be appropriate having regard for predefined sealing criteria, in particular if the push-buttons must be manipulated in a marine environment. According to a second embodiment, the push-buttons may be activated or deactivated in a synchronized manner by means of a rotatably mounted bezel. A suchlike design requires additional sealing gaskets in order to permit the actuation of the internal mechanism inside the case and is therefore not optimal in the light of the aforementioned criteria. Furthermore, a suchlike solution is not optimal for a graduated bezel intended to provide another function or an indication such as time-related information or information derived from the time.

Patent application CH700535 relates to a rotating bezel of asymmetric geometry, which, for a predefined angular position, is intended to conceal a crown for winding and/or adjusting a timepiece so as to prevent any unintentional manipulation. A suchlike solution is not optimal for a graduated bezel intended to provide another function or an indication such as time-related information or information derived from the time. Furthermore, the concealed component is not perfectly secured, given that it may be activated unintentionally from the "bottom" side of the watch case.

Patent application JP2005337792 relates to a rotating bezel which is intended, in a predefined angular position, to obstruct push-buttons in such a way as to block their translation. More specifically, a flank that is formed integrally with the bezel may be configured in order for it to be located within grooves formed on each of the push-buttons so as to constitute a device for activation and deactivation external to the watch case. The state of this device is provided here by markings disposed on the rotating bezel. A suchlike solution is not optimal, however, for a graduated bezel intended to provide another function or an indication such as time-related information or information derived from the time.

Patent application US20100128575 discloses a device similar to that in document JP2005337792. A rotating bezel acts on push-buttons by means of a locking element that is concentric with it. This locking element takes the form of a washer, which contains portions that are elastically deformable such as to enable them to obstruct the translation of the push-buttons. Like application JP2005337792, the state of the device is provided by markings that are disposed on the rotating bezel. A suchlike solution is not optimal, however, for a graduated bezel intended to provide another function or an indication such as time-related information or information derived from the time.

The aim of the invention is to provide a locking system intended to address the previously mentioned disadvantages and to improve the locking systems that are known from the prior art. In particular, the invention proposes a locking system that is compact, reliable and has a minimum impact on the aesthetics and the functions of the timepiece.

A watch case according to the invention is defined by point 1 below.

1. A watch case comprising a locking system for at least one control element of a timepiece, the locking system comprising:
   a manipulable element,
   a locking element for the at least one control element, and
   a kinematic link linking the manipulable element to the locking element,
   the locking system being arranged on the outside of a chamber, more particularly on the outside of a water-resistant chamber, defined by the case, the locking element being rotatably mounted, more particularly rotatably mounted about a second axis of the at least one control element.

Different embodiments of watch cases are defined by dependent points 2 to 13 below.

2. The watch case as defined in the preceding point, wherein the locking system comprises an element for displaying the state of locking of the at least one control element, more particularly a display element formed on the locking element or in a kinematic link with the locking element.
3. The watch case as defined in one of the preceding points, wherein the kinematic link comprises a toothing on the manipulable element and/or a toothing on the locking element.

4. The watch case as defined in one of the preceding points, wherein the at least one control element comprises at least one push-button and/or at least one crown.
5. The watch case as defined in one of the preceding points, wherein the manipulable element is rotatably mounted or is movably mounted in translation.
6. The watch case as defined in one of the preceding points, wherein the manipulable element comprises a ring and/or a bezel.
7. The watch case as defined in one of the preceding points, wherein the watch case comprises a bezel, and wherein the manipulable element comprises a ring movably mounted relative to the bezel, more particularly movably mounted in rotation about the bezel.
8. The watch case as defined in one of points 5 to 7, wherein the manipulable element is rotatably mounted relative to a first axis perpendicular or substantially perpendicular to a second axis of the at least one control element, or wherein the manipulable element is rotatably mounted relative to a first axis parallel or substantially parallel to a second axis of the at least one control element.
9. The watch case as defined in one of points 1 to 5, wherein the manipulable element is movably mounted in translation in a third axis perpendicular or substantially perpendicular to a second axis of the at least one control element.
10. The watch case as defined in one of the preceding points, wherein the locking element comprises an abutment preventing or limiting the displacement of the at least one control element and/or confining the control element in a first locked position.
11. The watch case as defined in the preceding point, wherein the abutment is arranged in such a way as to prevent or limit the displacement in translation of the at least one control element.
12. The watch case as defined in one of the preceding points, wherein the manipulable element is mobile between a first locking position of the at least one control element and a second unlocking position of the at least one control element.
13. The watch case as defined in one of the preceding points, wherein the manipulable element is adapted to be placed in a third position, more particularly a third intermediate position, between the first and second positions, in which at least one control element is locked and at least one control element is unlocked.

A timepiece according to the invention is defined by point 14 below.

14. A timepiece, in particular a wristwatch, comprising a watch case as defined in one of points 1 to 13.

The accompanying figures depict by way of example a plurality of embodiments of a timepiece incorporating a locking system.

Figure 11A:
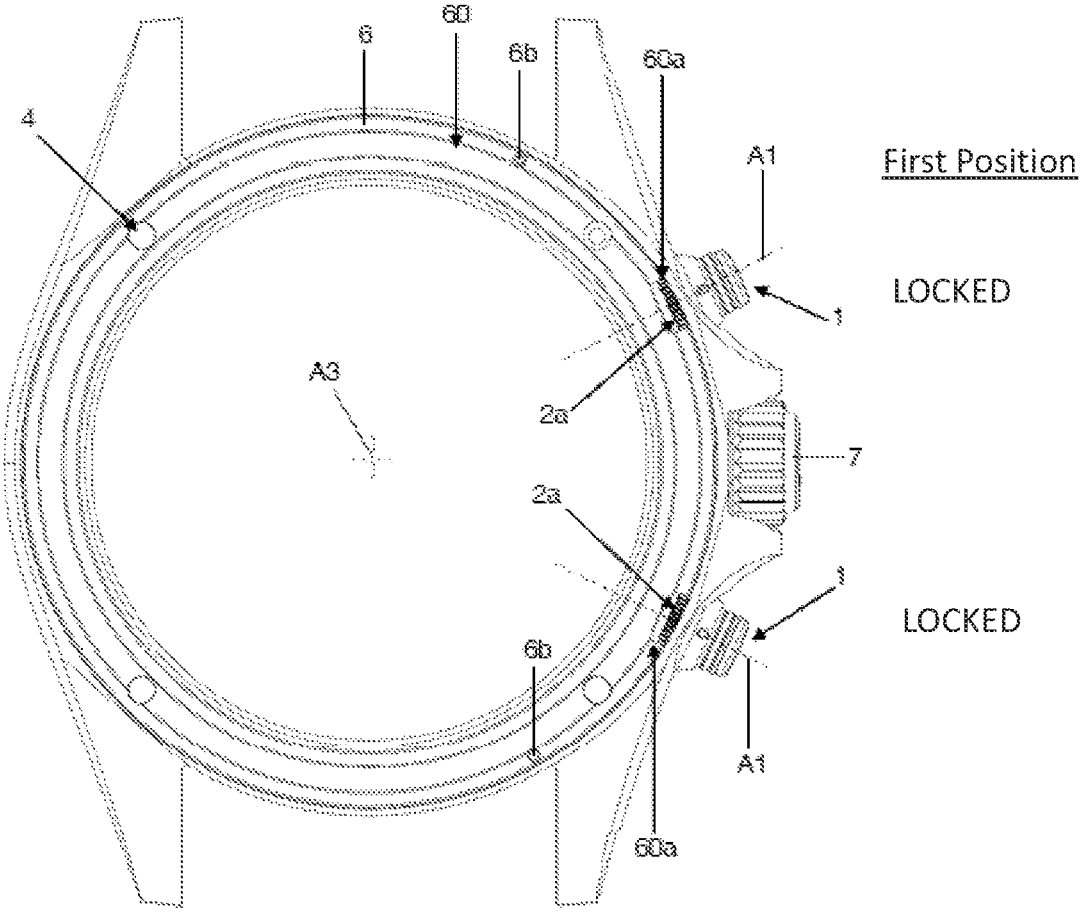
Figure 11B:
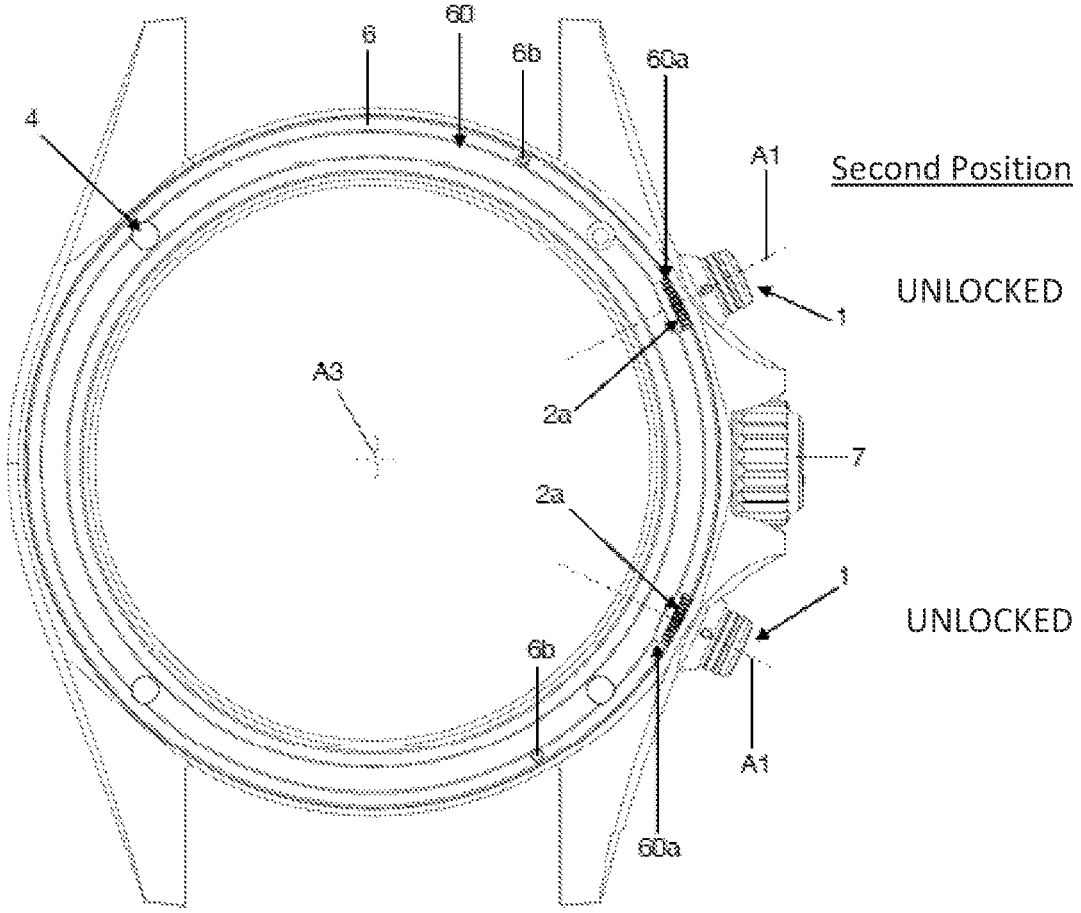
Figure 11C:
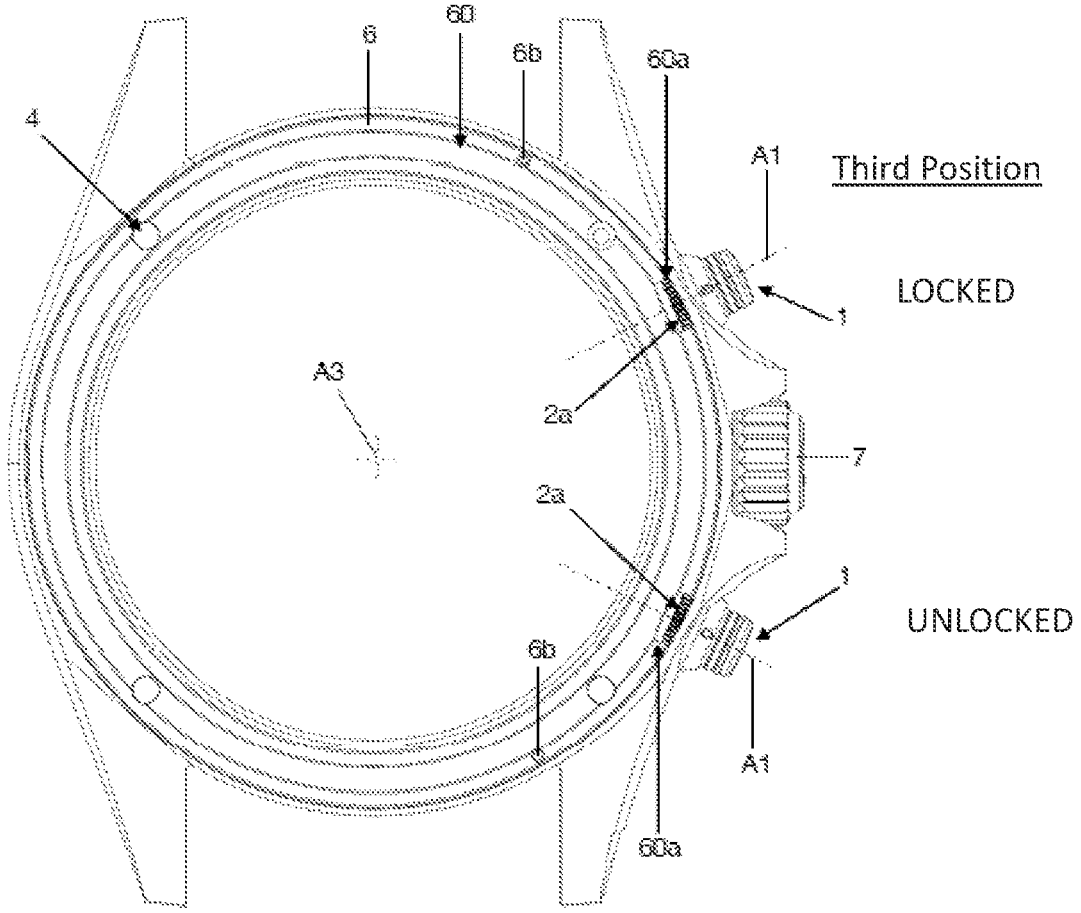

FIGS. 11A-C depict the control elements for different positions of the manipulatable element according to an embodiment of a timepiece.

A first embodiment of a timepiece 200 is described below with reference to FIGS. 1 to 8 and 10. The timepiece is a watch, for example, more particularly a wristwatch. The timepiece comprises a watch case 150 and a watch movement (not illustrated). The movement may be of the electronic type or the mechanical type. For example, the movement may be mechanical and automatic.

The watch case is used to enclose and protect the watch movement, more particularly to protect it from the environment in which the timepiece is present. Thus, the watch case constitutes a chamber 63 or an envelope, preferably a chamber or a water-resistant envelope, intended to receive the watch movement. The degree of water-resistance provided by the case may be higher of lower depending on the design and on the sealing gaskets that are used.

The watch case may essentially comprise a case middle 6, a back 61, a bezel 5 and a glass 62. Preferably, the bezel is a fixed bezel, that is to say a bezel immobilized on the case middle. The bezel 5 may be graduated, for example, and/or it may include indications, more particularly time indications or indications derived from the time. Preferably, these indications are not indications of the state of locking or unlocking of control elements.

The case further comprises one or a plurality of control elements 1, 7. The control elements are arranged in such a way that the wearer of the watch is able to act upon them, more particularly to translate them and/or to rotate them so as to transmit actions and displacements to the watch movement present in the watch case. In the illustrated embodiment, the control elements are a crown 7 and two push-buttons 1 or pushers 1. The control elements could differ in terms of their number and/or nature. In particular, the at least one control element could comprise a latch or a lever.

The control elements are utilized to perform different control actions of the movement, more particularly actions for winding a mainspring, actions for correcting watch functions, actions for the activation of watch functions, actions for the deactivation of watch functions or actions for resetting watch functions in a predetermined position.

For example, in the illustrated embodiment, the two push-buttons permit the operation of a chronograph. For example, a first push-button is used to activate and deactivate the chronograph, and a second push-button is used to reset the chronograph.

For example, in the illustrated embodiment, the crown is used, more particularly, to wind the movement and to correct the display of the current time.

The watch case likewise comprises a locking system 100 for at least one control element 1.

Preferably, the locking system is present or is arranged on the outside of the envelope 63 or of the chamber 63 defined by the case. Preferably, the locking system is thus not visible from the interior of the chamber defined by the watch case. More preferably, the locking system is arranged almost entirely inside the case middle, that is to say within the thickness of the case middle, or as close as possible to the case middle, on the outside thereof.

The system 100 for locking at least one control element 1 of the timepiece 200 comprises:

- a manipulable element 3,
- a locking element 2 for the at least one control element,
- a kinematic link 2*a*, 3*a* linking the manipulable element to the locking element.

Thus, the locking system includes a locking element, which is capable of being operated by means of the manipulable element 3.

The locking element 2 is used, depending on its state or its position, to permit or deny actuation of the at least one control element.

The at least one control element 1 preferably comprises at least one push-button 1 and/or at least one crown 7. In the embodiment described here, the at least one control element comprises two push-buttons.

Preferably, the two push-buttons preferably have identical or similar structures. Thus, a single control element 1 of the push-button type is described in detail below.

Advantageously, the control element 1 is provided in the area of the case middle of the case and permits the wearer to exert an action on the watch movement through this case middle.

Preferably, the control element 1 is movably mounted in translation in an axis A1 relative to the rest of the watch case, in particular relative to the case middle. This axis A1 is perpendicular to an axis A3 of the watch case, for example, that is to say the axis A3 of revolution of the watch dial (for a cylindrical or substantially cylindrical watch dial) and/or of the movement (for a cylindrical or substantially cylindrical movement), when the dial and/or the movement are mounted in the case. The axis A3 may be the axis of revolution of the hands. The axis A3 may likewise correspond to the axis of revolution of the annular bezel 5. Preferably, the axis A1 is parallel to the dial of the watch. Preferably, the axis A3 is perpendicular to the dial of the watch.

The control element 1 comprises a head 10 and a stem 11. The stem is secured to the head, for example by screwing, more particularly by screwing the stem 11 into a tapping provided in the head.

Furthermore, a hollow guideway is produced in the case, more particularly in the case middle, in order to receive the control element 1. This guideway is realized by a tube 12, for example, and more particularly a tube attached to the case middle. This tube is used to receive the stem 11 and to guide the latter as it slides relative to the case middle.

Sealing gaskets not illustrated in the figures may be disposed at the interface of the axis and the tube in such a way as to guarantee adequate sealing of the watch case.

The tube 12 may, in addition, include a first element 12*a* for retaining the head 10 in an angular position about the axis A1. This first retaining element cooperates advantageously with a second retaining element 10*a* provided on the head 10, in particular at the level of a skirt 101 of the head 10.

For example, the first retaining element may comprise external grooves 12*a*, and the second retaining element may comprise internal grooves 10*a*. These grooves are formed about the axis A1.

Thus, the control element is mounted in slidable engagement with an axis A1 in the tube and, consequently, in slidable engagement with an axis A1 relative to the case middle or to the rest of the watch case.

The tube 12 may be attached to the case middle 6, for example by driving, soldering, brazing, screwing or adhesive bonding. The tube may be indexed to the case middle 6 by conventional means of assembly.

Figure 5:
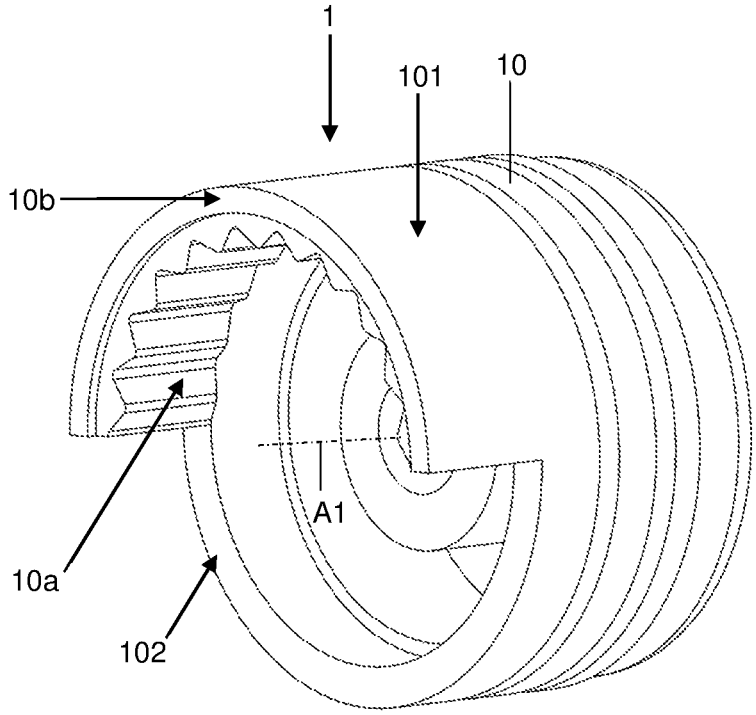

The control element nevertheless differs from conventional control elements of the push-button type in that the skirt 101 of the head 10 of the push-button 1 has a cut-out 102, of which the function is detailed below. In other words, the head 10 of the control element is asymmetric with a portion 10*b* which protrudes from the body of the head 10 of the push-button, as illustrated in FIG. 5.

Preferably, the manipulable element is rotatably mounted about the axis A3 in relation to the rest of the watch case, in particular relative to the case middle 6.

The manipulable element comprises a first ring 3. This first ring 3 is mounted rotatably about the bezel 5 and relative to the case middle 6. Preferably, this first ring has an L-shaped section exhibiting a first flange 31 extending radially (that is to say perpendicularly to the axis A3) underneath the bezel and a second flange 32 extending axially (that is to say parallel to the axis A3) on the periphery of the bezel. These two flanges thus provide two main functions.

The manipulable element provides a function for gripping by the wearer. Preferably, the second flange 32 provides this function. In such a case, it is this part 32 of the first ring 3 which may be gripped by the wearer between his fingers, and on which he may exert a mechanical action such as to cause the first ring to rotate about the bezel. In order to facilitate gripping and driving of the first ring by the wearer, the second flange may be equipped around its periphery with different gripping elements 3*c* such as slots.

The manipulable element provides a function for the transmission of the movement. Preferably, the first flange 31 provides essentially this function. In order to achieve this, the first flange comprises a first kinematic link element 3*a*. This first kinematic link element 3*a* is a first toothing 3*a*, for example. This first kinematic link element is disposed, for example, underneath the first flange 31 above which the bezel is disposed.

The movements, both axial and radial, relative to the axis A3 of the manipulable element 3 may be limited by the bezel 5.

Figure 6:
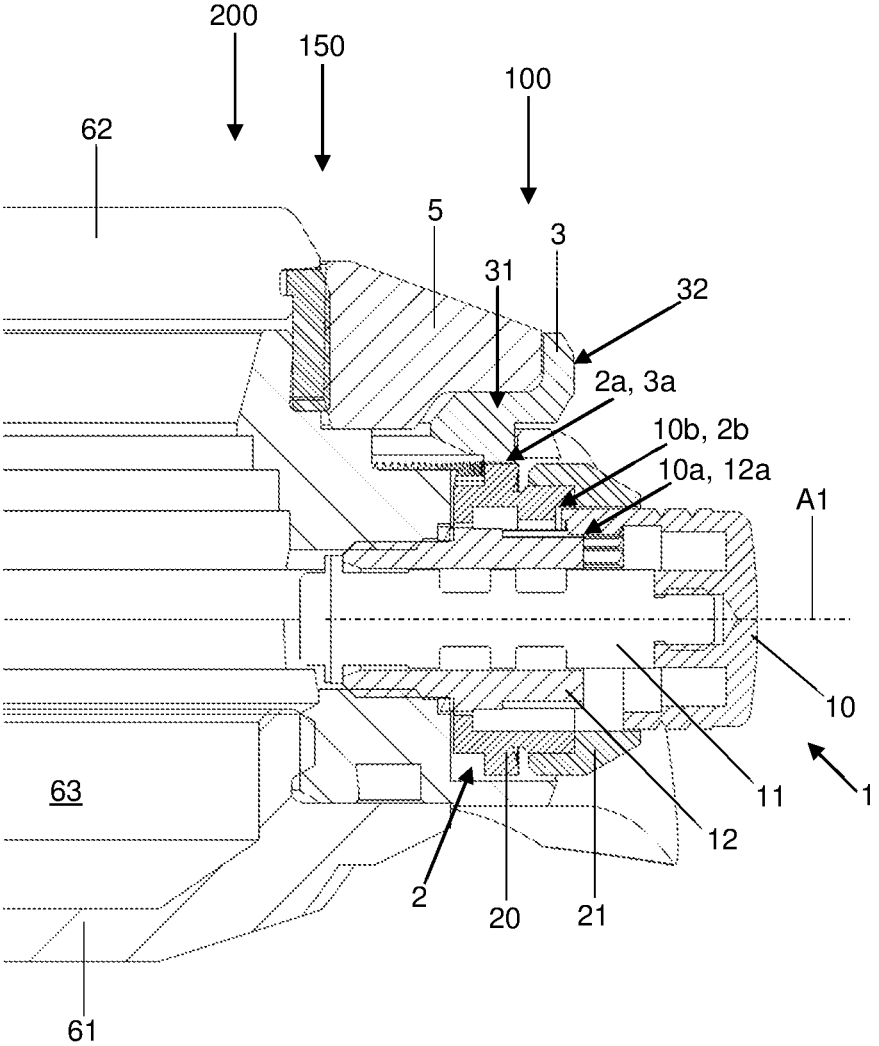
Figure 7:
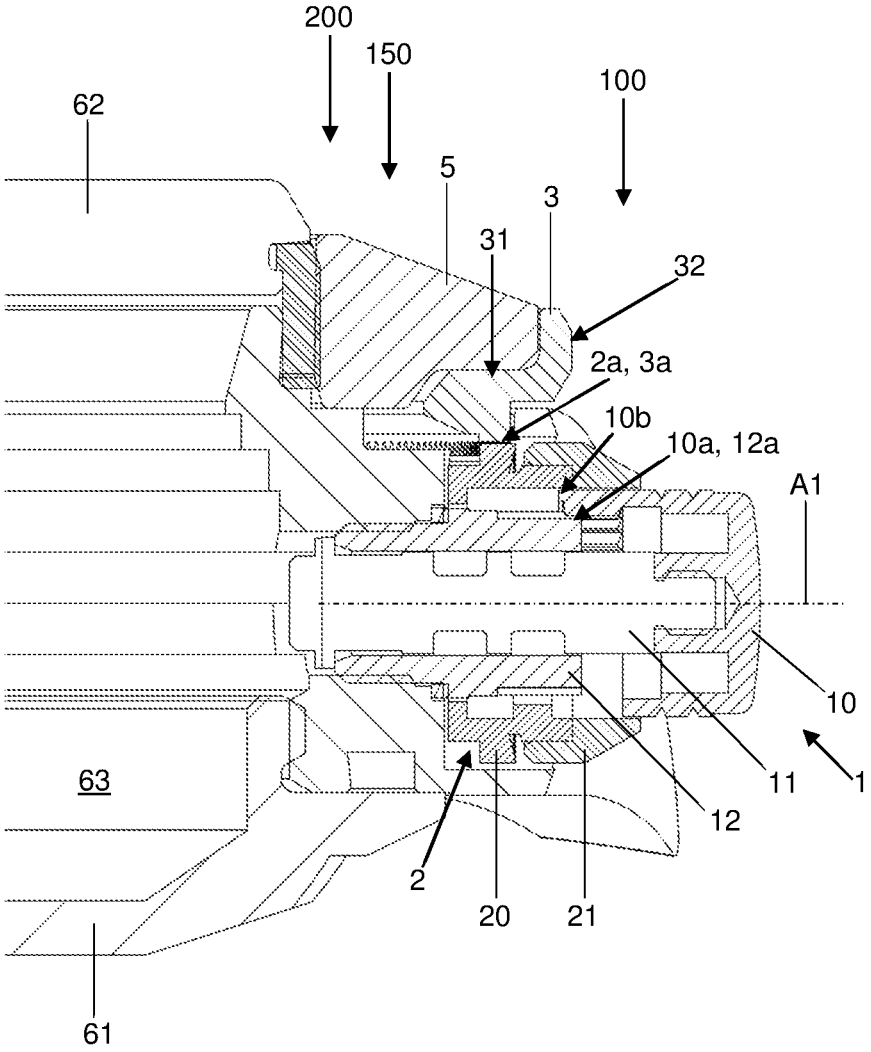

The manipulable element 3 is mobile between a first locking position for the at least one control element, that is to say a position in which a control element cannot be actuated or a control element cannot be actuated sufficiently for it act on the watch movement, and a second unlocking position for the at least one control element, that is to say a position in which it is possible to actuate a control element so that it acts on the watch movement. The first position is illustrated in FIG. 6, and the second position is illustrated in FIG. 7. The first and second positions are thus two angular positions of the manipulable element 3 which are distinct about the axis A3.

In order to achieve this, the manipulable element 3 may be indexed in position, for example, in these two positions relative to the other fixed components of the watch case, more particularly relative to the case middle 6. Thanks to a suchlike indexation, the two positions are stable and may be sensed by the wearer. Thus, the manipulable element preferably comprises a first indexing element 33. This first element cooperates with a second indexing element 34 in order to produce the indexation. This second indexing element is realized, for example, on or in another fixed component of the watch case, more particularly on or in the case middle 6.

For example, the indexing device may comprise first indexing elements of the type recesses 33, more particularly recesses realized underneath the manipulable element, in particular underneath the first flange 31 of the first ring 3. For example, the indexing device comprises second indexing elements of the type ball-type pawls 34, comprising balls 4 contained in holes 42 and tensioned by means of springs 41 against the manipulable element. These second indexing elements are provided, for example, on the case middle 6. They are disposed, for example, on the periphery or on the circumference of the case middle 6, or on an annular seat 60 of the case middle 6.

The first toothing 3*a* may be partial on the manipulable element. The manipulable element may exhibit as many toothed sectors 3*a* as there are locking elements 2 for operating or for positioning. The toothing or toothings 3*a* may be frontal toothings.

Figure 8:
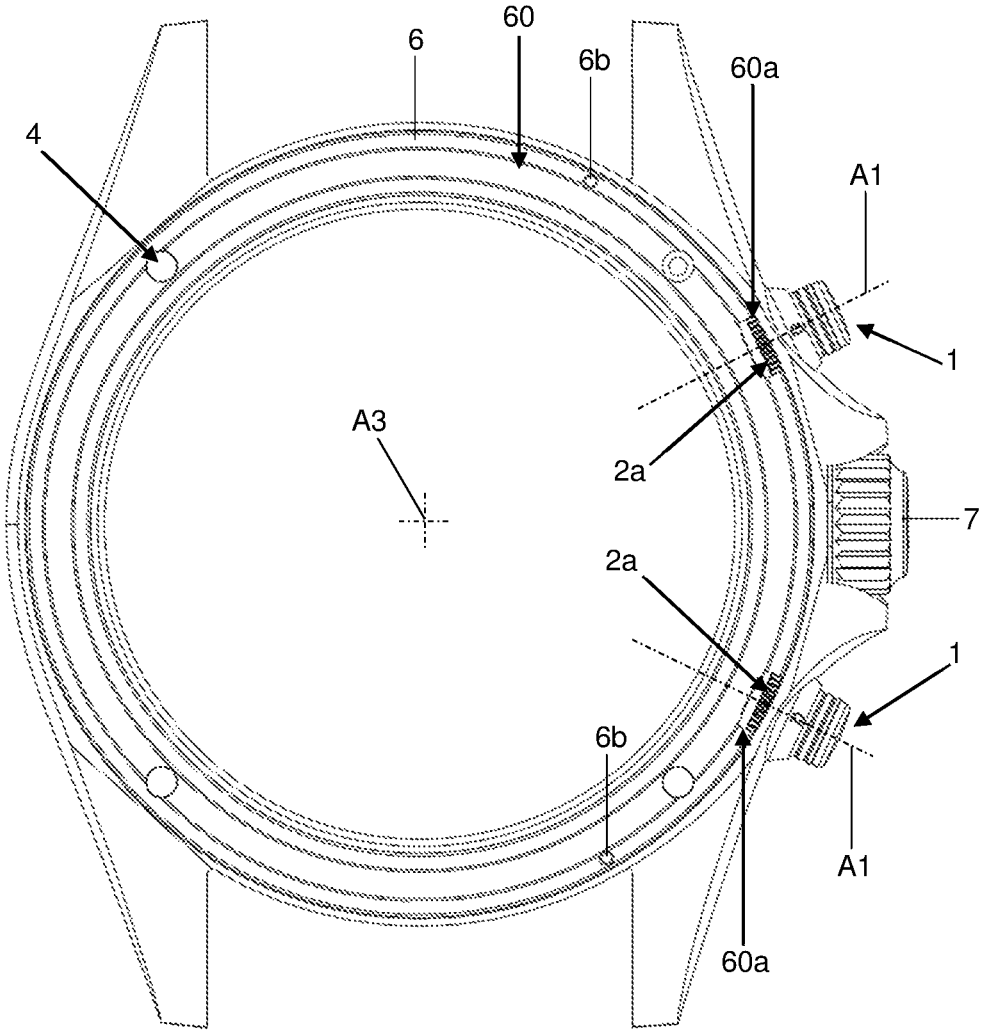

The manipulable element 3 may include one or a plurality of abutments 3*b* intended to cooperate by positive engagement with another abutment or a plurality of other abutments 6*b* provided on the case middle 6, as illustrated in FIG. 8. These abutments limit the rotation of the manipulable element about the axis A3.

The locking element 2 comprises preferably at least one means of locking a push-button 1 and/or a crown. In the embodiment described here, the locking element 2 comprises means of locking two push-buttons 1.

Preferably, the two means of locking have identical or similar structures. Thus, a single means of locking 2 is described in detail below.

The locking element 2 is rotatably mounted, more particularly rotatably mounted about the axis A1 of the control element, relative to the rest of the watch case, in particular relative to the case middle. The locking element is locked in translation on the axis A1 of the control element, relative to the rest of the watch case, in particular relative to the case middle, more particularly by the control element 1. Preferably, the locking element has the overall form of a second ring 2. This second ring is advantageously disposed around the control element 1.

The locking element comprises a first abutment 2*b* preventing or limiting the displacement for the at least one control element. This first abutment 2*b* is intended to cooperate with a second abutment 10*b* provided on the control element 1. For example, the second abutment is an extremity 10*b* of the skirt 101 of the push-button 1.

Figure 3:
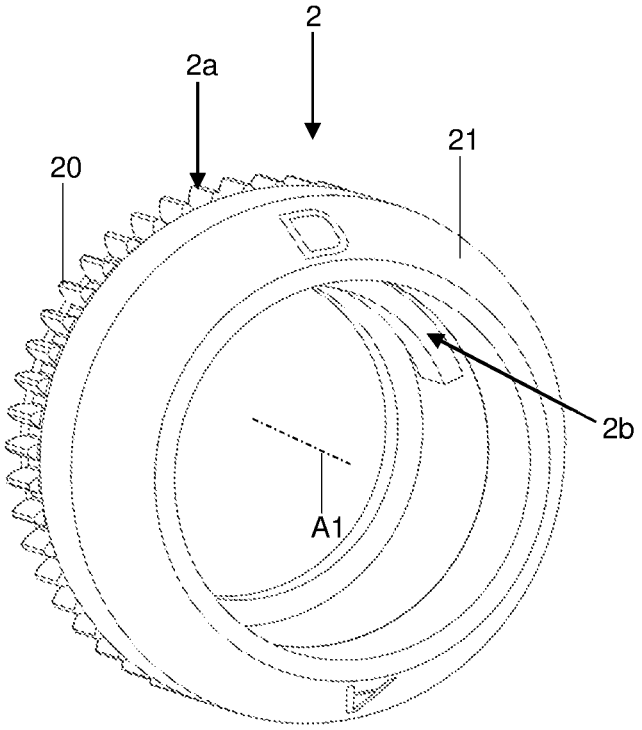
Figure 4:
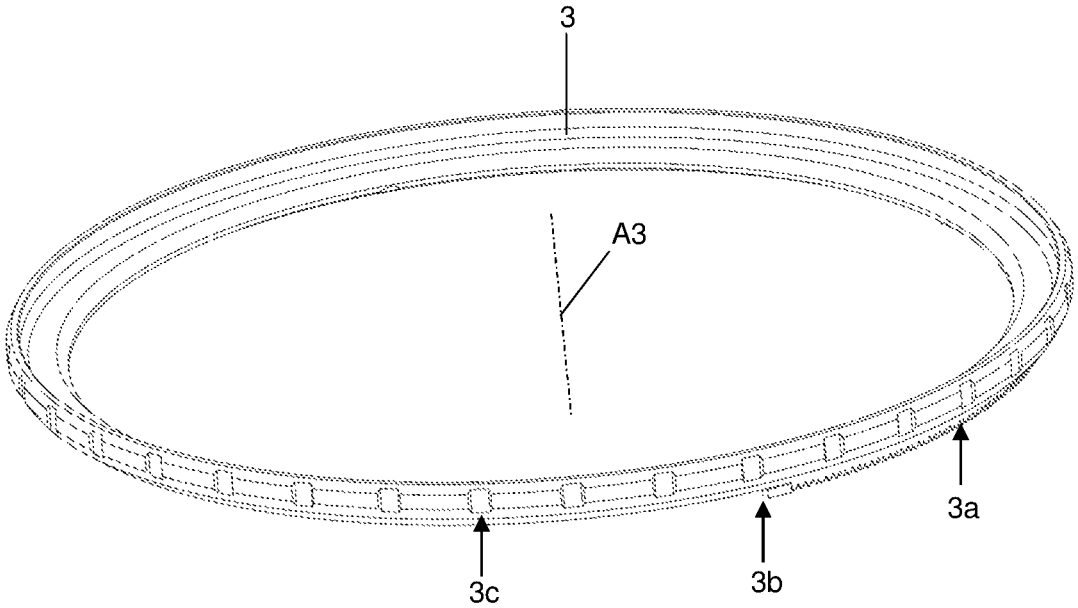

The first abutment 2*b* is, for example, an internal shoulder or an internal collar provided in a bore of the second ring 2 and extending preferably for less than 180° about the axis A1, as illustrated in FIG. 3.

Likewise, the second abutment 10*b* extends preferably for less than 180° about the axis A1.

Thus, in a first relative position of the locking element 2 and of the control element 1 about the axis A1 illustrated in FIG. 6, the first and second abutments cooperate and confine or lock the control element in one position. In fact, the first and second abutments face one another and the translation of the control element in the axis A1 is prevented or limited, more particularly having regard for the manufacturing and assembly tolerances of the components. The wearer is thus not able to operate the watch movement via the control element.

In a second relative position of the locking element 2 and the control element 1 about the axis A1 illustrated in FIG. 7, the first and second abutments are not able to cooperate. In fact, the first and second abutments are no longer facing one another, and the translation of the control element in the axis A1 is no longer limited by the abutments. The wearer is thus able to act on the watch movement via the control element.

The locking system preferably comprises an element 21 for displaying the state of locking of the at least one control element. Advantageously, the display element 21 is formed on the locking element. For example, the locking element, in particular the second ring 2, may include one or more indications or markers corresponding to the state of locking and/or unlocking of the control element 1.

Figure 1:
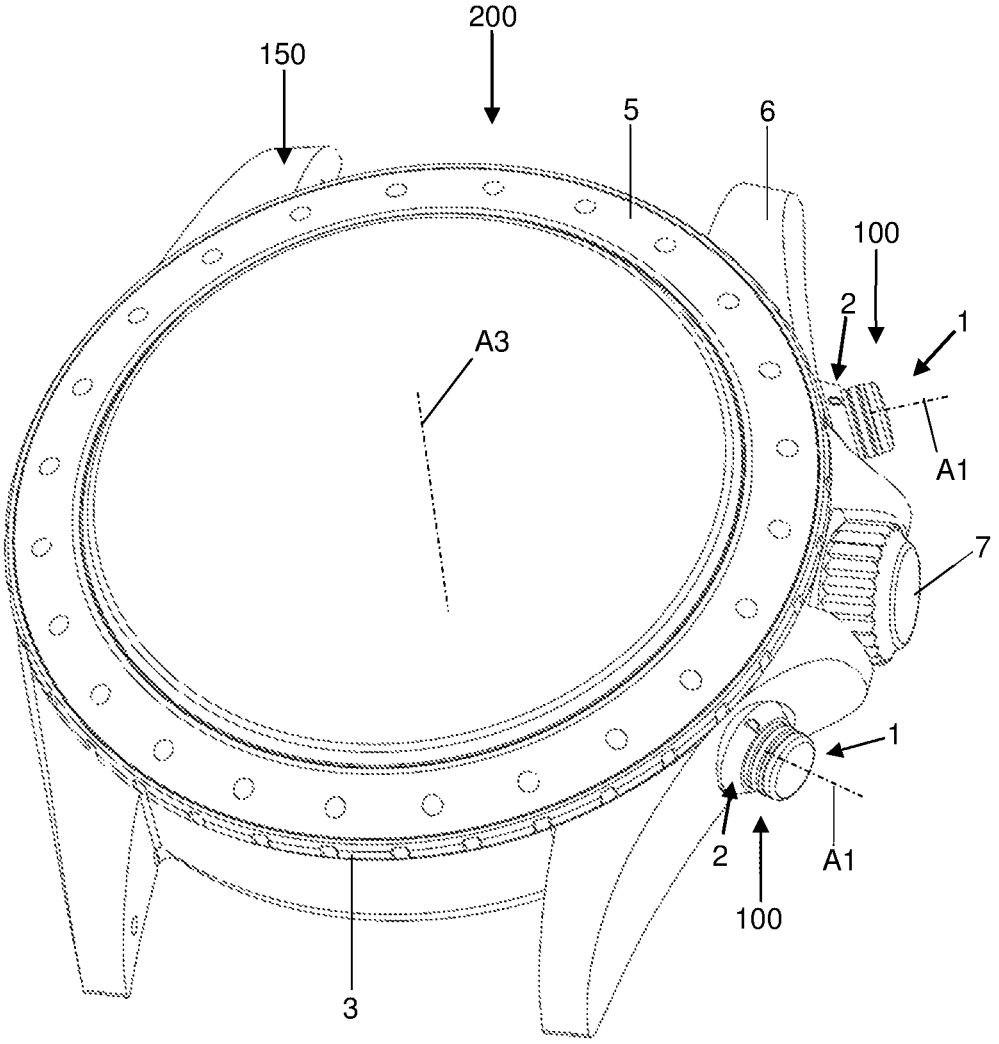
FIGS. 1 to 8 depict a first embodiment of a timepiece.
Figure 2:
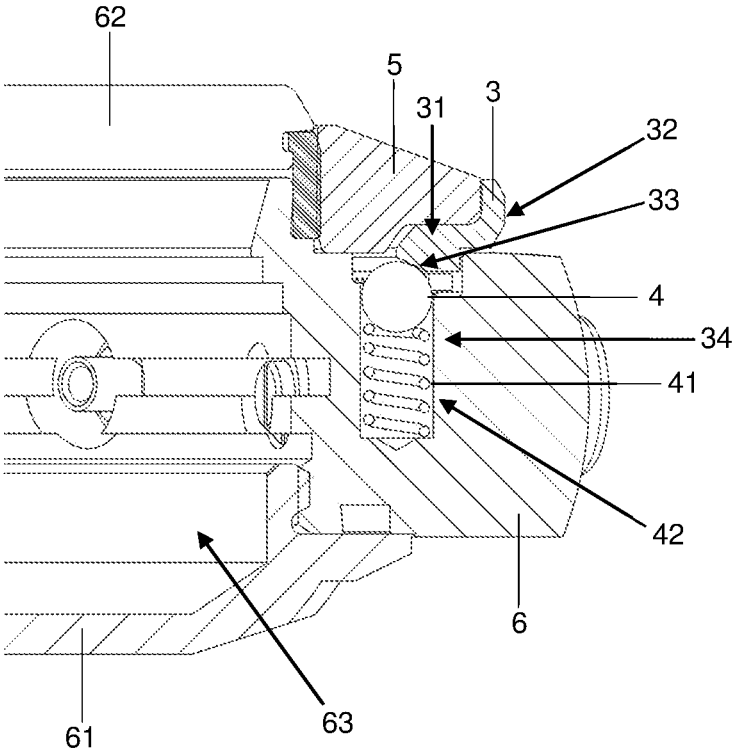

In order to achieve this, the locking element 2 may more particularly include an indicator means 21 provided in order to indicate the state of the control element. This indicator means 21 may more particularly be provided with indications or markings informing the wearer of the watch about the state of activation of the control element. By way of example, FIGS. 1 and 3 illustrate an indicator means 21 provided with engravings "A" and "D", "A" corresponding to the activated or unlocked state of the control element and "D" corresponding to the deactivated or locked state of the control element. As an alternative, the indicator means may, for example, be provided with a color code corresponding to each of the states of the push-button.

The locking element has the overall form of a second ring 2, which may comprise a body of a ring 20, to which the indicator means 21 is attached. The indicator means 21 may, for example, be secured to the body 20 by driving, by soldering, or by brazing.

The locking element preferably comprises a toothing 2*a*. The toothing is an external toothing 2*a*, for example, provided around the second ring 2, more particularly provided around the body 20 of the second ring.

The locking element 2 may be pivoted on the tube 12 and/or on the head 10. Advantageously, the locking element 2 is delimited axially in the axis A1 by a flank of the case middle 6 and by the head 10 of the control element.

The kinematic link comprises, for example, the first toothing 3*a* produced on the manipulable element and the second toothing 2*a* produced on the locking element. Preferably, the first and second toothings cooperate directly for meshing with one another. As an alternative, the first and second toothings may cooperate with one another via an intermediate element such as an intermediate wheel.

In the illustrated embodiment, the toothings 2*a* and 3*a* cooperate in the area of the annular seat 60 of the case middle 6. In order to achieve this, the annular seat 60 is equipped with at least one cut-out 60*a* such that the contact operates between the toothings 2*a* and 3*a*. This cooperation between the toothings 2*a* and 3*a* takes place downstream of the sealing gaskets disposed between the elements constituting the case of the timepiece, more particularly between the members 1 and 6, 5 and 6, and 61 and 6. Thus, this kinematic link is of no consequence for the sealing of the watch case.

Preferably, the kinematic link is desmodromic.

The kinematic link may be of any nature, provided that:

- a passage from the first position to the second position of the manipulable element brings about, via this kinematic link, a passage from the first position to the second position of the locking element; and
- a passage from the second position to the first position of the manipulable element brings about, via this kinematic link, a passage from the second position to the first position of the locking element.

FIG. 6 represents a cross-sectional view of the control element 1 in the locked configuration. In this configuration, the manipulable element 3 is disposed, preferably retained, in a first angular position determined in such a way that it positions, and preferably retains, the locking element in a defined angular position in such a way that it prevents translation of the control element. In order to achieve this, the locking element 2 is provided with the collar 2*b* intended to cooperate by positive engagement with a portion 10*b* of the head 10 of the control element 1. Thus, in this configuration, the locking element 2 is oriented in such a way that the collar 2*b* opposes translation of the control element by constituting an abutment for the head 10, more particularly for a portion 10*b* of the head.

FIG. 7 represents a cross-sectional view of the control element 1 in the unlocked configuration. In this configuration, the manipulable element 3 is positioned, and preferably retained, in a second angular position determined in such a way that it positions, and preferably retains, the locking element 2 in a defined angular position in such a way that it permits translation of the control element. In order to achieve this, the locking element 2 is positioned in such a way that the collar 2*b* is positioned out of reach of the portion 10*b* of the head 10. Thus, the control element 1 may be translated on a sufficiently large portion to activate a function of the watch movement.

The passage from the locked configuration of the FIG. 6 to the unlocked configuration of the FIG. 7 occurs by a rotation of the locking element 2 about the axis A1, more particularly by a rotation of the locking element 2 at an angle $\alpha$2 of 180°. The rotation of the locking element 2 occurs under the effect of the rotation of the manipulable element 3, which is itself caused to rotate by the wearer of the watch, more particularly by being caused to rotate at an angle $\alpha$3 less than or equal to 180°, or less than or equal to 45°, or less than or equal to 30°, about the axis A3. For example, the manipulable element 3 is intended to rotate through an angle of 24° or thereabouts.

Of course, the manipulable element 3 may lock and unlock a plurality of control elements 1, more particularly two control elements 1, simultaneously. Advantageously, the manipulable element 3 thus permits the locking or unlocking of two control elements, in one and the same operation.

Figure 9:
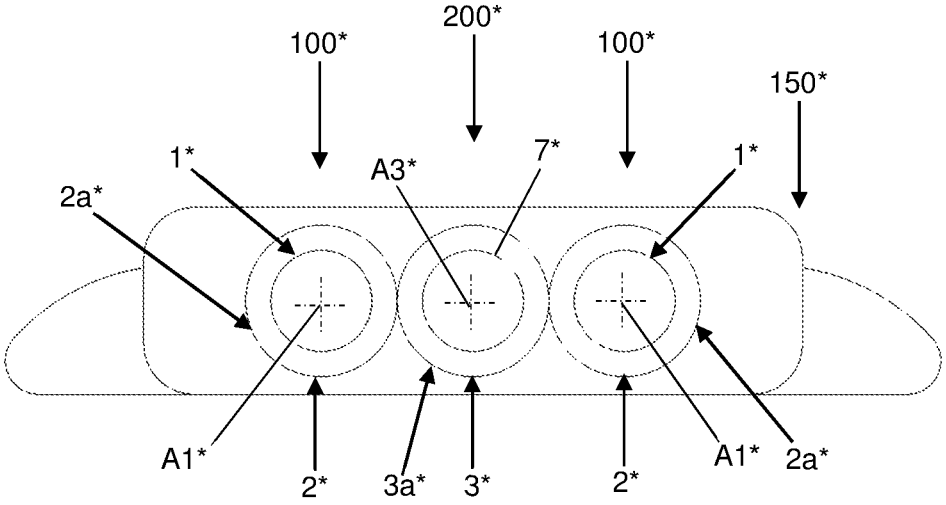
FIG. 9 depicts a second embodiment of a timepiece.

A second embodiment of a timepiece is described below with reference to FIG. 9.

The timepiece 200* comprises a watch case 150* equipped with a locking system 100* for at least one control element 1*.

The locking system 100* for at least one control element 1* of the timepiece 200, comprises:

a manipulable element 3*, a locking element 2* for the at least one control element, a kinematic link 2*a, 3*a linking the manipulable element to the locking element.

This second embodiment differs or differs essentially from the first embodiment in that the manipulable element 3* is rotatably mounted relative to a first axis A3* parallel or substantially parallel to a second axis A1* for the at least one control element. In addition, or as an alternative, the axes A1* and A3* may be present in the same plane or substantially in the same plane, more particularly a plane parallel to the plane of movement of the timepiece or in a plane parallel to the dial of the timepiece.

The manipulable element 3* may be disposed concentrically to a rewinding crown 7* which is positioned between two push-buttons 1* around which are disposed locking elements 2*. The manipulable element is, for example, a first ring 3* and the locking elements are, for example, second rings 2*. These rings advantageously exhibit toothings 2*a and 3*a engaging with one another. Thus, in this second embodiment, the two control elements 1* may be locked or unlocked, by rotation of the ring 3*, in one and the same operation.

As an alternative to the different embodiments and variants described here, the kinematic link may comprise pins as a replacement for a toothing 2*a* or 3*a*.

As an alternative to the different embodiments and variants described here, the kinematic link may comprise a system resembling a Maltese cross, more particularly a Maltese cross that is integral with the locking element 2 and cooperating with protrusions such as pegs or pins that are integral with the manipulable element.

As an alternative or in addition to the different embodiments and variants described here, the manipulable element may include indications corresponding to the state of locking or unlocking of the one or more control elements.

As an alternative to the different embodiments and variants described here, the manipulable element and/or the locking element may be movable in translation relative to the rest of the watch case, in particular relative to the case middle.

As an alternative to the different embodiments and variants described here, the manipulable element may be a rotating bezel.

In addition to the different embodiments and variants described here, the manipulable element may be positioned in a third position, more particularly a third intermediate position, between the first and second positions, in which at least one control element is locked and at least one control element is unlocked as shown in FIG. 11C. The first position may be a position in which all the control elements are locked as shown in FIG. 11A, and the second position may be a position in which no control element is locked as shown in FIG. 11B.

As an alternative to the different embodiments and variants described here, the display element 21 may be in a kinematic link with the locking element, and more particularly the display element may be a separate component of the locking element and/or of the manipulable element and may be driven mechanically by the locking element and/or by the manipulable element.

Figure 10:
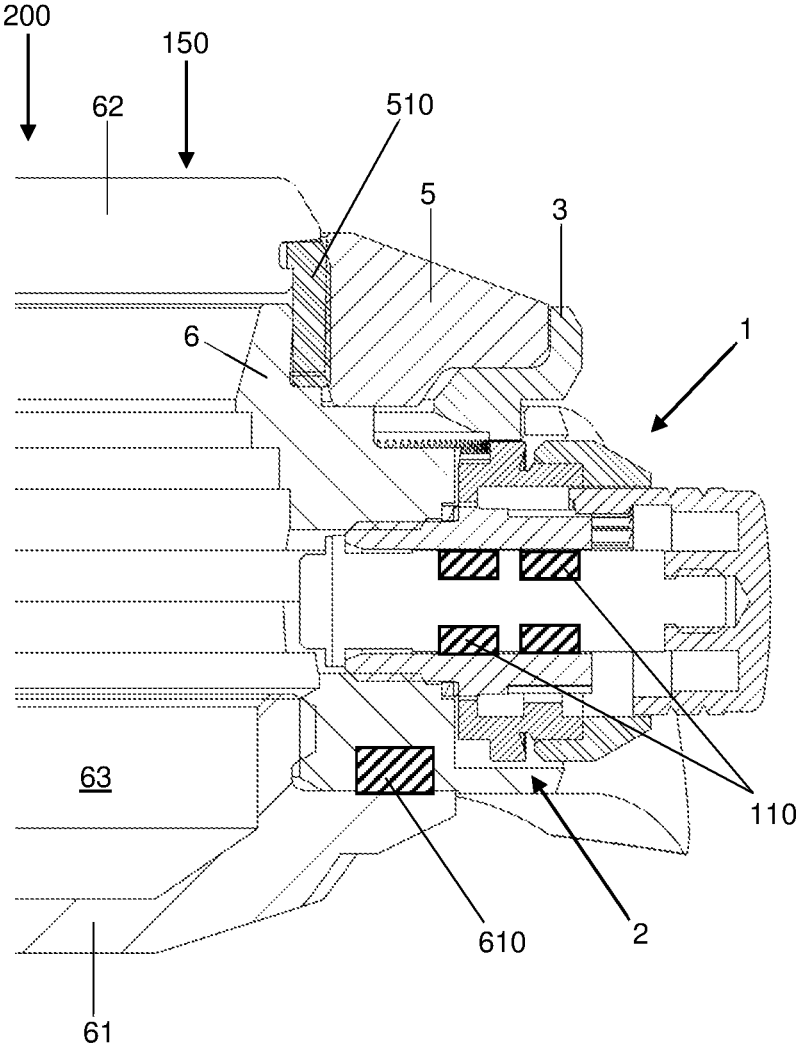
FIG. 10 is a view in cross-section of a timepiece according to the first embodiment having a plurality of depicted sealing gaskets for the case.

In the different embodiments and variants described here, the locking system is external to the chamber 63 constituted by the watch case. This chamber is more particularly delimited by the case middle 6, the back 61 of the case middle 6, the bezel 5, the glass 62 and the control element 1. Preferably, a first sealing gasket 610 is disposed between the back 61 and the case middle 6, a second sealing gasket 510 is disposed between the case middle 6 and the bezel 5, a second sealing gasket 510 is disposed between the case middle 6 and the glass 62, a third sealing gasket 110 is disposed between the case middle 6 and a control element 1, so that the chamber 63 constitutes a water-resistant chamber. Suchlike sealing gaskets may be implemented by one or a plurality of seals. By way of example, FIG. 10 depicts the sealing gaskets capable of being disposed at the interface of the aforementioned elements.

In the different embodiments and variants described here, the locking elements 2 are largely included in the thickness of the case middle. In the first embodiment, the manipulable element is largely situated on the bezel/case middle interface. As to the kinematic link, it is situated in the case middle.

It is thus possible to produce a reliable watch case having a locking system for control elements which integrates perfectly with the aesthetics of a watch, in particular a watch equipped with a graduated bezel.

The invention claimed is:

1. A watch case comprising a locking system for at least one control element of a timepiece, the locking system comprising:

a manipulable element, a locking element for the at least one control element, and a kinematic link linking the manipulable element to the locking element, wherein the locking system is arranged on the outside of a chamber defined by the case, and wherein the locking element is rotatably mounted relative to the case middle about an axis of the at least one control element.

2. The watch case as claimed in claim 1, wherein the locking system comprises an element for displaying the state of locking of the at least one control element.

3. The watch case as claimed in claim 2, wherein the element for displaying the state of locking of the at least one control element is a display element formed on the locking element or in a kinematic link with the locking element.

4. The watch case as claimed in claim 1, wherein the kinematic link comprises a toothing on the manipulable element and/or a toothing on the locking element.

5. The watch case as claimed in claim 1, wherein the at least one control element comprises at least one push-button and/or at least one crown.

6. The watch case as claimed in claim 1, wherein the manipulable element is rotatably mounted or is movably mounted in translation.

7. The watch case as claimed in claim 6, wherein the manipulable element is rotatably mounted relative to a first axis perpendicular or substantially perpendicular to a second axis of the at least one control element.

8. The watch case as claimed in claim 6, wherein the manipulable element is rotatably mounted relative to a first axis parallel or substantially parallel to a second axis of the at least one control element.

9. The watch case as claimed in claim 1, wherein the manipulable element comprises a ring and/or a bezel.

10. The watch case as claimed in claim 1, wherein the watch case comprises a bezel, and wherein the manipulable element comprises a ring movably mounted relative to the bezel.

11. The watch case as claimed in claim 10, wherein the ring is movably mounted in rotation about the bezel.

12. The watch case as claimed in claim 1, wherein the manipulable element is movably mounted in translation in a third axis perpendicular or substantially perpendicular to a second axis of the at least one control element.

13. The watch case as claimed in claim 1, wherein the locking element comprises an abutment preventing or limiting the displacement of the at least one control element and/or confining the control element in a first locked position.

14. The watch case as claimed in claim 13, wherein the abutment is arranged in such a way as to prevent or limit the displacement in translation of the at least one control element.

15. The watch case as claimed in claim 1, wherein the manipulable element is mobile between a first locking position of the at least one control element and a second unlocking position of the at least one control element.

16. The watch case as claimed in claim 15, wherein the manipulable element is adapted to be placed in a third position between the first locking and second unlocking positions, in which at least one control element is locked and at least one control element is unlocked.

17. A timepiece comprising a watch case as claimed in claim 1.

18. The watch case as claimed in claim 1, wherein the chamber is a water-resistant chamber.

19. The watch case as claimed in claim 18, wherein the locking element is rotatably mounted about a second axis of the at least one control element.

* * * * *